US006021923A

United States Patent [19]

Shipway

[11] Patent Number: 6,021,923

[45] Date of Patent: Feb. 8, 2000

[54] TRANSFER APPARATUS

[75] Inventor: Malcolm Shipway, Bristol, United Kingdom

[73] Assignee: David S. Smith Packaging Limited, London, United Kingdom

[21] Appl. No.: 09/038,725

[22] Filed: Mar. 10, 1998

[51] Int. Cl.[7] ..... B67D 5/00

[52] U.S. Cl. ..... 222/83; 222/91

[58] Field of Search ..... 222/83, 91

[56] References Cited

FOREIGN PATENT DOCUMENTS

| | | |
|---|---|---|
| 2154991 | 9/1985 | United Kingdom . |
| 2163136 | 2/1986 | United Kingdom . |
| 2183617 | 6/1987 | United Kingdom . |
| WO94/18110 | 8/1994 | WIPO . |

*Primary Examiner*—Philippe Derakshani
*Attorney, Agent, or Firm*—Blakely Sokoloff Taylor & Zafman

[57] ABSTRACT

There is shown respectively the other and the one part of a set of parts which when assembled provides a transfer apparatus for transferring flowable material such as food or drink powder, or a liquid such as a drinks concentrate, from a source thereof (not shown) in the form of a plastic bag of a gauge which is pierceable. That bag is usually held in a container such as a cardboard box. The bag and its contents are sterilised and delivered sterile to a point of use, where the bag is pierced to effect transfer. To effect such transfer, the one part, which is an adapter plug is secured to a gland which is part of the bag, though in an alternative the one part may itself be a gland integral with the bag. The other part is tubular and hollow, and has an internal thread in a lower (as viewed) part separated by a shoulder from an upper (as viewed) unthreaded tubular part which has a gland for attachment to another filament, such as a tube (not shown). The lower part has two opposed through bores in its boundary wall, for facilitating ingress of flowable material during transfer. The collar supports sealing means in the embodiment in the form of an element comprising two longitudinally spaced flexible and resilient flanges or lips, which are substantially parallel and are tapered from root to tip to form a respective wedge shape in cross-section, the upper (as viewed) surface being inclined at 15° to the horizontal and the lower (as viewed) surface being inclined at 35° to the horizontal.

26 Claims, 3 Drawing Sheets

TRANSFER APPARATUS

The invention relates to transfer apparatus, to a device for transfer and to a set of parts for assembly to provide such apparatus.

Flowable material such as powder and liquids are often used in the food industry, particularly catering. Such powder or liquid is often held in a source such as a plastic container or bag where it is maintained sterile. To transfer the material to a point of use, the bag has to be pierced, usually under sterile conditions, using a transfer piercing apparatus which connects the source via that apparatus to a point of use, for example a mixer which dispenses a drink of a required flavour. It is important that for both hygienic and economic reasons, the transfer is effected cleanly, efficiently and without waste of material.

It is accordingly an object of the invention to seek to provide apparatus which at least mitigates unhygienic, wasteful and inefficient transfer.

According to a first aspect of the invention there is provided a device for effecting transfer of material from a source thereof by piercing, comprising a hollow body through which material is transferred and sealing means carried by the body and arranged to seal against flow of material past the body during transfer.

The sealing means may comprise a circumferential element on the body. This provides a relatively simple construction, particularly when the element may comprise a bead, two spaced beads, or a flexible or resilient flange.

There may be two flexible or resilient flanges. This provides a construction which has a wiping yet sealing action.

According to a second aspect of the invention there is provided a set of parts for assembly for transferring flowable material from a source which is pierced by the assembled set to effect transfer, the set comprising two parts one of which receives the other for relative movement therebetween when assembled to effect transfer, and sealing means of the assembled set, the arrangement being such that the sealing means effects sealing between the parts during transfer so leakage is hindered or obviated.

The other part may be received in the one part with the sealing means therebetween. This provides a relatively simple construction.

The other part may comprise a hollow body and the sealing means may be carried by the body. This can promote efficient yet non-leakage transfer.

The sealing means may comprise a circumferential element on the body, preferably a bead. This provides a relatively simple construction, particularly where there may be two spaced beads, or alternatively a flexible or resilient flange, suitably two such flanges which are spaced apart.

The flanges may comprise projections from a collar of the body. This provides a simple construction, and the flanges may be angled with respect to the plane of the collar, to provide for sealing, which may be enhanced by the flanges being tapered from root to tip.

The collar may comprise a seat for an additional seal. This provides an additional seal when the assembled set is fully assembled with the other part fully home in the one part.

The seat may comprise a groove adapted to receive an 'O' ring seal. This is a relatively simple construction.

There may be resistance means hindering relative movement ofthe two parts. This prevents unintentional transfer, particularly where the resistance means may comprise a detent, which may be overcome to effect transfer.

The other part may comprise a piercing device which is tubular.

Alternatively the other part may comprise a piercing device which is a cap.

The one part may comprise a gland device adapted for mounting on a source of material, or alternatively the one part may comprise a gland device integral with a source of material.

According to a third aspect of the invention there is provided transfer apparatus, comprising an assembled set of parts as hereinbefore defined.

A device, a set of parts, and transfer apparatus, for effecting transfer of material from a source thereof by piercing are hereinafter described, by way of example, with reference to the accompanying drawings.

Figure 1:
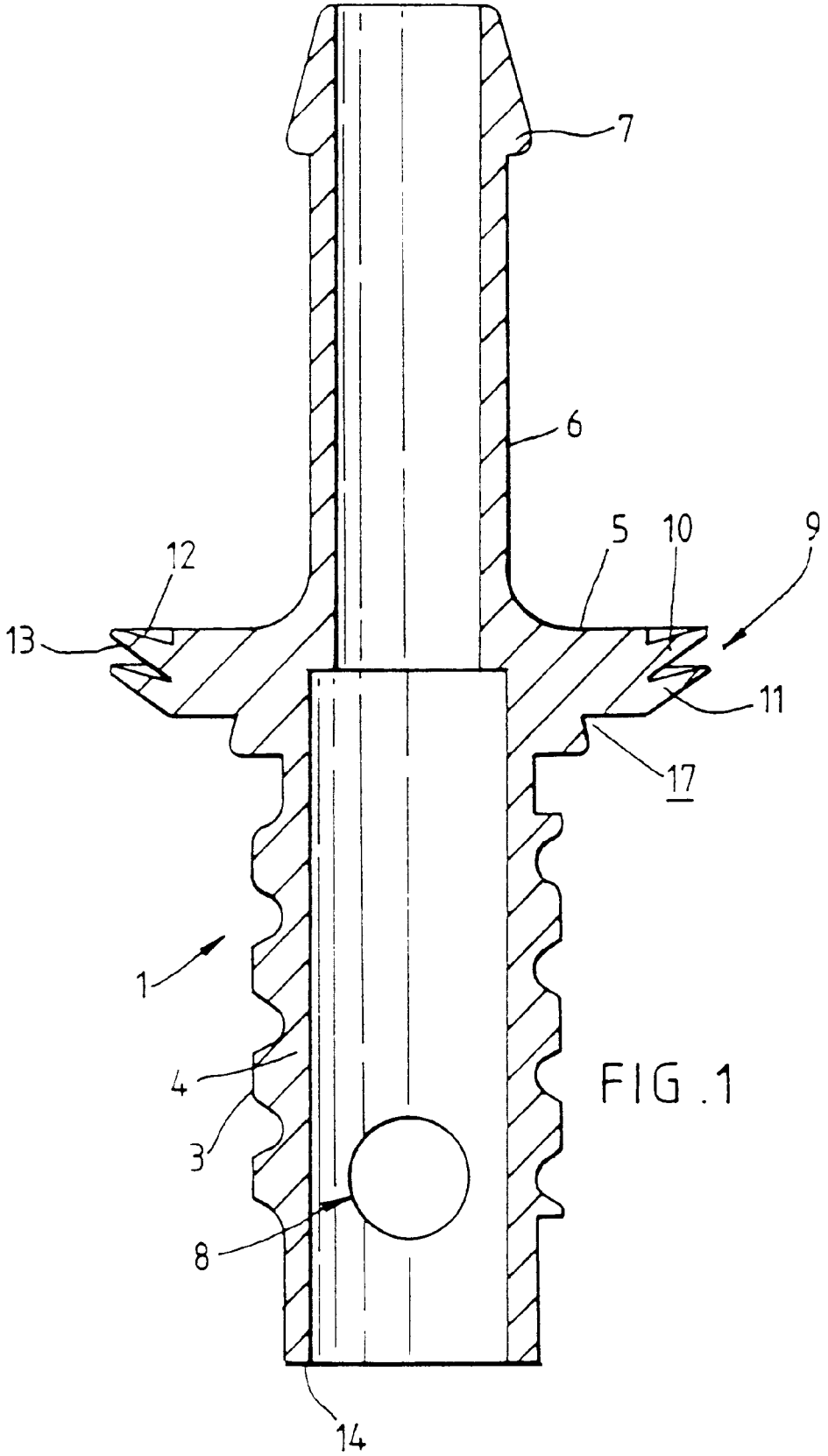
FIG. 1 is a longitudinal sectional view of a tubular piercing device which is part of a set of parts according to the invention for effecting transfer of flowable material from a source thereof by piercing.
Figure 2:
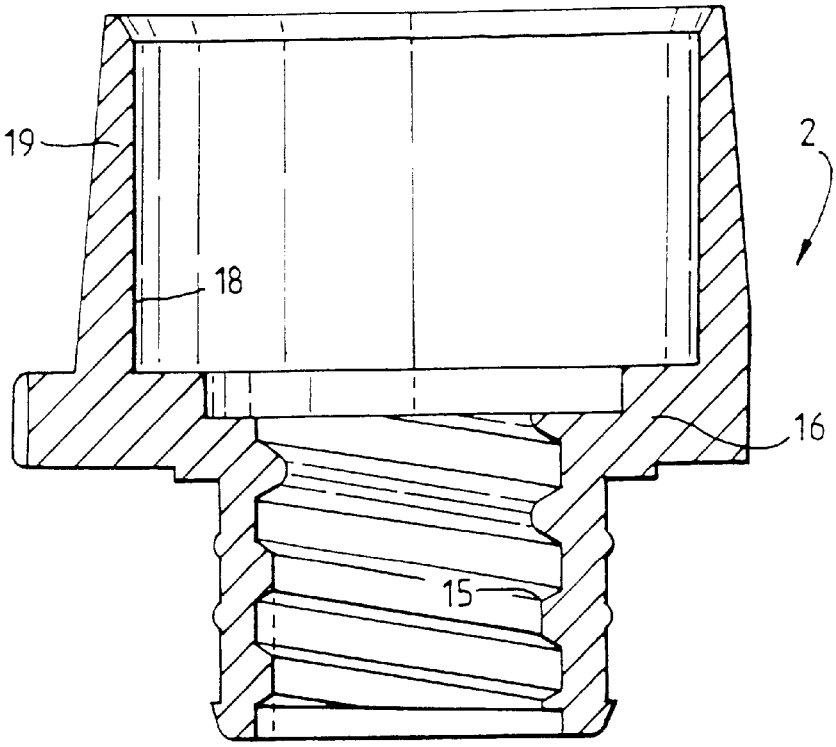
FIG. 2 is another part of the set of parts according to the invention.

Referring firstly to FIGS. 1 and 2, there is shown respectively the other 1 and the one 2 part of a set of parts which when assembled provides a transfer apparatus for transferring flowable material such as food or drink powder, or a liquid such as a drinks concentrate, from a source thereof (not shown) in the form of a plastic bag of a gauge which is pierceable. That bag is usually held in a container such as a cardboard box. The bag and its contents are sterilised and delivered sterile to a point of use, where the bag is pierced to effect transfer. To effect such transfer, the one part 2, of FIG. 2, which is an adapter plug is secured to a gland which is part of the bag, though in an alternative the one part 2 may itself be a gland integral with the bag. The other part 1 is tubular and hollow, and has an internal thread 3 in a lower (as viewed) part 4 separated by a shoulder 5 from an upper (as viewed) unthreaded tubular part 6 which has a gland 7 for attachment to another fitment, such as a tube (not shown). The lower part 4 has two opposed through bores 8 in its boundary wall, for facilitating ingress of flowable material during transfer. The collar 5 supports sealing means 9 in the embodiment in the form of an element comprising two longitudinally spaced flexible and resilient flanges or lips 10, 11 which are substantially parallel and are tapered from root to tip to form a respective wedge shape in cross-section, the upper (as viewed) surface being inclined at 15° to the horizontal and the lower (as viewed) surface 13 being inclined at 35° to the horizontal.

There is in the one part 2, or other part 1, not shown, a resistance element in the form of a detent which is shearable. The arrangement is such that when the two parts 1, 2 of the set formed thereby are assembled, with the other part 1 in the one part 2, and the other part 1 is rotated relative to the one part 2, the detent means prevents undesired relative movement of the two parts 1, 2 until sufficient axial pressure is applied to the tubular piercing part 1 to shear the detent so that the piercing part 1 can move through one part 2 so that its end 14 can contact, and then pierce, the bag to open up the interior of the bag to the interior of the tubular piercing part 1 for transfer of material. During the movement of the other part 1 into the one part 2 by rotation and cooperation of the thread 3 with integral thread 15 of the one part 2, after piercing the other part 1 is rotated until it is fully "home" with the collar 5 seated on a shoulder 16 of the one part 2, the 'O' ring (not shown) in a seating 17 of the other part providing an additional seal. During this motion to the fully home position, the flanges 10, 11 "wipe" along the inner boundary of a bore 18 of a body 19 of the one part 2, the tips of the flanges at least being resilient enough to flex slightly away from the direction of motion, and the diameters of the flanges 10, 11 being just greater than the diameter of the bore 18 of the body 19. Thus any tending of the material to "leak" during transfer by passage over the outside of the thread 3 of the tubular piercing member 1 is obviated by the flanges 10, 11 so making for a hygienic, efficient and non-wasteful transfer of products.

Figure 3:
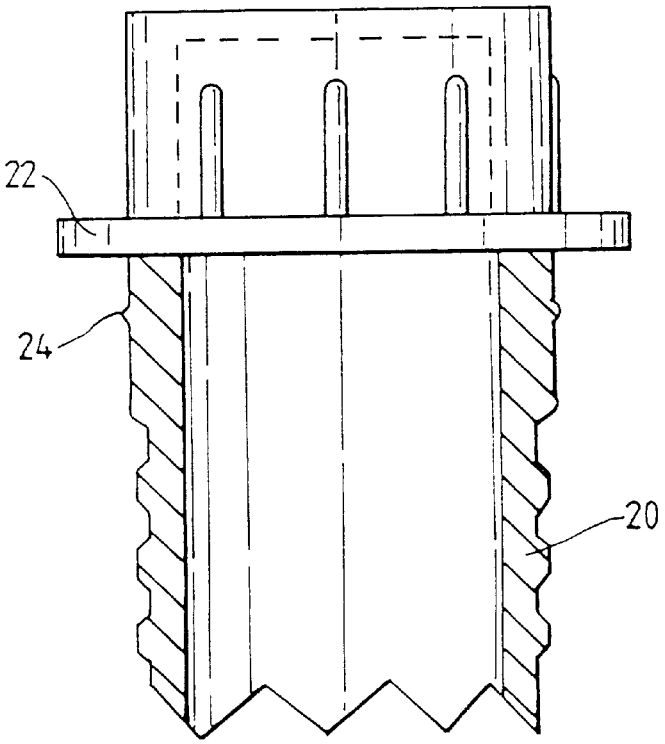
FIGS. 3 and 4 show, to a smaller scale longitudinal sectional views of respective parts of a further embodiment of a set of parts according to the invention.
Figure 4:
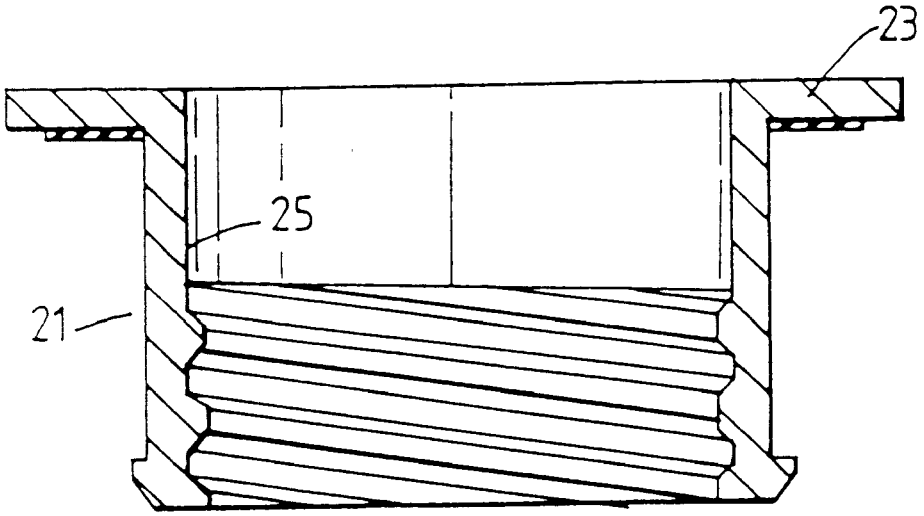
Figure 5:
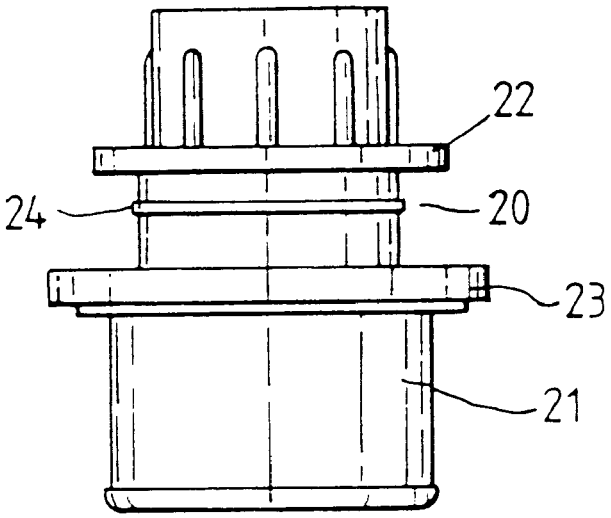
FIG. 5 is a side view of the set of parts of FIGS. 3 and 4. assembled.

Turning now to the second embodiment, shown in FIGS. 3 to 5, the embodiment is similar in construction and operation to that of FIGS. 1 and 2. In the second embodiment the other part 20 comprises a cap member which is screwed into the one part 21 to effect piercing of the bag, but once pierced the other part 20 when screwed "home" with its collar 22 on a collar 23 of the one part 21, transfer is prevented by the cap, however, leakage of material during relative movement of the two parts 20, 21 is prevented by sealing means 24 in the form of a bead, which has an outside diameter just greater than the diameter of the bore 25, but not sufficient to prevent entry of the other part 20 and movement to the fully "home" position. There is as in the first embodiment, resistance means (not shown) such as a detent, the resistance which must be overcome before piercing of the bag is effected.

In the second embodiment, the cap 20 can be applied after transfer using tubular piercing part 1 like that of the first embodiment, to close the bag as required, whilst preventing leakage of product, again providing an hygienic, efficient and non-wasteful embodiment. The parts 1, 2 and the parts 20, 21 form sets of parts for effecting transfer of material.

It will be understood that in all embodiments the respective parts of the set are made from any suitable material such as polypropylene. In FIG. 4, the collar may have an additional seal such as a compressed or compressible washer to obviate leakage past the collar when the one part is in position on a bag.

I claim:

1. A device for effecting transfer of material from a source thereof by piercing, comprising:

(i) one part having a hollow body through which materials is to be transferred;

(ii) another part having sealing means comprising two spaced circumferential elements on the body; and (iii) the said sealing means being arranged to seal with the said hollow body whereby to obviate flow of material past the body during transfer.

2. A device as defined in claim 1, wherein the sealing means comprises a circumferential element on the body.

3. A device as defined in claim 2, wherein the element comprises a bead.

4. A device as defined in claim 2, wherein the element comprises two spaced beads.

5. A device as defined in claim 2, wherein the element comprises a resilient flange.

6. A device as defined in claim 2, wherein the element comprises two spaced resilient flanges.

7. A set of parts for assembly for transferring flowable material from a source which is pierced by the assembled set to effect transfer, comprising:

(i) two parts;

(ii) one of said parts receiving the other for relative movement therebetween when assembled to effect transfer; and (iii) sealing means of the assembled set, whereby the sealing means effects sealing between the parts during transfer so preventing leakage, said sealing means comprising two spaced circumferential elements on the body.

8. A set as defined in claim 7, wherein the other part is received in the one part with the sealing means therebetween.

9. A set as defined in claim 8, whereby the other part comprises a hollow body and wherein the sealing means is carried by the other part.

10. A set as defined in claim 8, wherein the sealing means comprises a circumferential element on the body.

11. A set as defined in claim 10, wherein the element comprises a bead.

12. A set as defined in claim 10, wherein the element comprises two spaced beads.

13. A set as defined in claim 10, wherein the element comprises a resilient flange.

14. As set as defined in claim 10, wherein the element comprises two spaced resilient flanges.

15. A set as defined in claim 14, wherein the body carries a collar and wherein the flanges comprise projections from said collar.

16. A set as defined in claim 14, wherein the body comprises a collar and wherein the flanges comprise projections which are angled with respect to the plane of the collar.

17. A set as defined in claim 16, wherein the flanges are tapered from root to tip.

18. A set as defined in claims 15, wherein the collar comprises a seat for an additional seal.

19. A set as defined in claim 17, wherein the seat comprises a groove adapted to receive an 'O' ring seal.

20. A set as defined in claim 7, further comprising a resistance means for hindering relative movement of the two parts.

21. A set as defined in claim 7, further comprising a resistant means comprises a detent.

22. A set as defined in claim 7, wherein the other part comprises a piercing device which is tubular.

23. A set as defined in claim 7, wherein the other part comprises a piercing device which is a cap.

24. A set as defined in claim 7, wherein the one part comprises a gland device adapted for mounting on a source of material.

25. A set as defined in claim 7, wherein the one part comprises a gland device integral with a source of material.

26. Transfer apparatus, comprising an assembled set of parts as defined in claim 7.

* * * * *

UNITED STATES PATENT AND TRADEMARK OFFICE

CERTIFICATE OF CORRECTION

PATENT NO. : 6,021,923
DATED : February 8, 2000
INVENTOR(S) : Shipway

It is certified that error appears in the above-identified patent and that said Letters Patent is hereby corrected as shown below:

Title page,
Item [56], References Cited, please add the following U.S. Patent Documents:

| | | | |
|---|---|---|---|
| 3,973,698 | 8/1976 | Kato | 222/91 |
| 4,723,687 | 2/1988 | Kutterer | 222/91 |
| 5,111,970 | 5/1992 | Rutter et al | 222/91 |
| 5,671,770 | 9/1997 | Rusche et al | 222/91 |

Column 3,
Line 47, please delete "through which materials is to be transferred" and insert -- through which material is to be transferred --.

Claim 14, column 4,
Line 30, please delete "As set as defined in claim 10" and insert -- A set as defined in claim 10 --.

Signed and Sealed this

Sixth Day of November, 2001

*Attest:*

Nicholas P. Godici

*Attesting Officer*

NICHOLAS P. GODICI
*Acting Director of the United States Patent and Trademark Office*